US005130043A

United States Patent [19]

Prince et al.

[11] Patent Number: 5,130,043

[45] Date of Patent: Jul. 14, 1992

[54] LIQUID AUTOMATIC DISHWASHING COMPOSITIONS HAVING ENHANCED STABILITY

[75] Inventors: Mark J. Prince, Blue Ash; Thomas H. Glassco, Cincinnati, both of Ohio

[73] Assignee: The Procter & Gamble Company, Cincinnati, Ohio

[21] Appl. No.: 524,679

[22] Filed: May 9, 1990

Related U.S. Application Data

[63] Continuation of Ser. No. 204,445, Jun. 9, 1988, abandoned.

[51] Int. Cl.[5] ..... C11D 1/34; C11D 3/395; C11D 3/37; C11D 3/56

[52] U.S. Cl. ..... 252/95; 252/99; 252/174.14; 252/174.16; 252/174.17; 252/174.21; 252/174.24; 252/174.25; 252/550; 252/552; 252/554

[58] Field of Search ..... 252/99, 103, 174.22, 252/174.24, DIG. 14, 95, 174.16, 174.17, 174.21, 174.25, 550, 552, 554, 174.14

[56] References Cited

U.S. PATENT DOCUMENTS

| | | | |
|---|---|---|---|
| 2,674,619 | 4/1954 | Lundsted | 260/485 |
| 2,677,700 | 5/1954 | Jackson et al. | 260/488 |
| 2,979,528 | 4/1961 | Lundsted | 260/584 |
| 3,036,118 | 5/1962 | Jackson et al. | 260/484 |
| 3,048,548 | 8/1962 | Martin et al. | 252/135 |
| 3,255,117 | 6/1966 | Knapp et al. | 252/99 |
| 3,314,891 | 4/1967 | Schmolka et al. | 252/89 |
| 3,352,785 | 11/1967 | Corliss et al. | 252/99 |
| 3,899,387 | 8/1975 | Freis et al. | 162/158 |
| 4,006,091 | 2/1977 | Lindblom et al. | 252/90 |
| 4,077,897 | 3/1978 | Gault | 252/99 |
| 4,095,035 | 6/1978 | Lamberti et al. | 560/180 |
| 4,147,650 | 4/1979 | Sabatelli et al. | 252/103 |
| 4,215,004 | 7/1980 | Borgerding et al. | 252/156 |
| 4,226,736 | 10/1980 | Bush et al. | 252/135 |
| 4,240,919 | 12/1980 | Chapman | 252/95 |
| 4,436,637 | 3/1984 | Ramachandran et al. | 252/8.7 |
| 4,491,539 | 1/1985 | Hoskins et al. | 252/541 |
| 4,522,740 | 6/1985 | Schmid et al. | 252/174.21 |
| 4,548,729 | 10/1985 | Schmid et al. | 252/174.21 |
| 4,608,188 | 8/1986 | Parker et al. | 252/99 |
| 4,624,803 | 11/1986 | Balzer et al. | 252/527 |
| 4,661,279 | 4/1987 | Parker | 252/94 |
| 4,661,280 | 4/1987 | Ouhadi et al. | 252/99 |
| 4,686,254 | 8/1987 | Lochhead et al. | 524/99 |
| 4,703,114 | 10/1987 | Mori et al. | 536/4.1 |
| 4,726,909 | 2/1988 | Otten et al. | 252/174.21 |
| 4,740,327 | 4/1988 | Julemont et al. | 252/103 |
| 4,752,409 | 6/1988 | Drapier et al. | 252/94 |
| 4,824,590 | 4/1989 | Roselle | 252/90 |
| 4,836,948 | 6/1989 | Corring | 252/99 |
| 4,839,077 | 6/1989 | Cramer | 252/98 |
| 4,867,896 | 9/1989 | Elliott | 252/94 |

FOREIGN PATENT DOCUMENTS

| | | |
|---|---|---|
| 0082564 | 6/1983 | European Pat. Off. . |
| 197434 | 10/1986 | European Pat. Off. . |
| 0239379 | 9/1987 | European Pat. Off. . |
| 264826 | 4/1988 | European Pat. Off. . |
| 264975 | 4/1988 | European Pat. Off. . |
| 2615698 | 10/1977 | Fed. Rep. of Germany . |
| 2854484 | 6/1980 | Fed. Rep. of Germany . |
| 3023828 | 2/1982 | Fed. Rep. of Germany . |
| 62-032198 | 2/1987 | Japan . |
| 63-061093 | 3/1988 | Japan . |
| 1527706 | 10/1978 | United Kingdom . |
| 2048841 | 12/1980 | United Kingdom . |
| 2116199 | 9/1983 | United Kingdom . |
| 2140450 | 11/1984 | United Kingdom . |
| 2164350 | 3/1986 | United Kingdom . |
| 2176495 | 12/1986 | United Kingdom . |
| 2185037 | 7/1987 | United Kingdom . |
| 2193724 | 2/1988 | United Kingdom . |
| 2194954 | 3/1988 | United Kingdom . |
| 2196972 | 5/1988 | United Kingdom . |

OTHER PUBLICATIONS

Product Literature for Carbopol 600 Series from B. F. Goodrich Company.

B. F. Goodrich Co., "Carbopol ® 600 Resins in Liquid Detergents and Cleaners," pp. 1–4 and 12 (undated).

*Primary Examiner*—John Niebling
*Assistant Examiner*—Mark Bender
*Attorney, Agent, or Firm*—Mary P. McMahon; Gretchen B. Hatfield; Kathleen M. Harleston

[57] ABSTRACT

Thickened aqueous automatic dishwashing detergent compositions comprising polycarboxylate polymers and phosphate esters having enhanced stability and cohesiveness.

14 Claims, No Drawings

LIQUID AUTOMATIC DISHWASHING COMPOSITIONS HAVING ENHANCED STABILITY

This is a continuation of application Ser. No. 204,445, filed on Jun. 9, 1988, now abandoned.

TECHNICAL FIELD AND BACKGROUND ART

This invention relates to aqueous automatic dishwashing detergent compositions which have a yield value and are shear-thinning. Compositions of this general type are known. Examples of such compositions are disclosed in U.S. Pat. No. 4,116,851 to Rupe et al, issued Sep. 26, 1978; U.S. Pat. No. 4,431,559 to Ulrich, issued Feb. 14, 1984; U.S. Pat. No. 4,511,487 to Pruhs et al, issued Apr. 16, 1985; U.S. Pat. No. 4,512,908 to Heile, issued Apr. 23, 1985; Canadian Patent 1,031,229, Bush et al; European Patent Application 0130678, Heile, published Jan. 9, 1985; European Patent Application 0176163, Robinson, published Apr. 2, 1986; UK Patent Application 2,116,199A, Julemont et al, published Sep. 21, 1983; UK Patent Application 2,140,450A, Julemont et al, published Nov. 29, 1984; UK Patent Application 2,163,447A, Colarusso, published Feb. 26, 1986; and UK Patent Application 2,164,350A, Lai et al, published Mar. 19, 1986.

The state of the art liquid automatic dishwashing detergent compositions typically thickened with clay still suffer from phase separation upon storage under certain conditions. However, it has now been discovered that such compositions are improved by the utilization of certain-thickening and stabilizing agents. More specifically, automatic dishwashing detergent compositions comprising a polycarboxylate thickener and certain phosphate ester stabilizers have improved phase stability and cohesiveness.

The use of polyacrylic thickeners in liquid automatic dishwashing detergent compositions is known. See, for example, U.K. Patent Application 2,185,037, Dixit, published Jul. 8, 1987, which discloses liquid automatic dishwashing detergents which contain a long chain carboxylic or polycarboxylic acid as the thickener. Also, European Patent Application 0239379, Brumbaugh, published Sep. 9, 1987, teaches that polyacrylate is useful for water spot reduction in liquid automatic dishwashing detergent compositions. U.S. Pat. No. 4,226,736 to Bush et al, issued Oct. 7, 1980, teaches that a polymer of acrylic acid can be used as a thickener in liquid automatic dishwashing detergents instead of clay.

The use of phosphate esters, in general, in automatic dishwashing detergent compositions is also known. See, for example, U.K. Patent Application 2,116,199, Julemont et al, published Sep. 21, 1983, which teaches the use of an alkyl ester of phosphoric acid as a foam depressor.

The combination of polyacrylate thickeners and phosphate ester plus clay has also been taught in U.K. Patent Application 2,164,350, Lai et al, published Mar. 19, 1986. The polyacrylate thickeners taught to be useful have molecular weights of up to 500,000 (preferably up to 50,000). These compositions are said to be useful for protection of glazing on fine china.

It has now been found that if a polyacrylate thickener and certain phosphate esters are used together in the absence of clay in an automatic dishwashing detergent composition, enhanced phase stability and improved dispensing of the product from its container are achieved.

SUMMARY OF THE INVENTION

The compositions of this invention are thickened aqueous automatic dishwasher detergent compositions comprising:

(1) from 0% to about 5%, preferably from about 0.1% to about 2.5%, of a bleach-stable, preferably low-foaming, detergent surfactant;

(2) from about 5% to about 40%, preferably from about 15% to about 30%, of a detergency builder, especially a builder selected from the group consisting of sodium tripolyphosphate, sodium carbonate, potassium pyrophosphate, sodium pyrophosphate, and mixtures thereof;

(3) a hypochlorite bleach to yield available chlorine in an amount from about 0.3% to about 2.5%, preferably from about 0.5% to about 1.5%;

(4) from about 0.1% to about 10%, preferably from about 0.2% to about 2%, of a polycarboxylate polymer having a molecular weight of from 500,000 to 5,000,000, preferably from about 750,000 to about 4,000,000; and (5) from about 0.1% to about 5%, preferably from about 0.15% to about 1%, of a $C_{12}$–$C_{18}$ alkyl ester of phosphoric acid;

said composition containing essentially no clay suspension agents, and having a yield value of from about 50 to about 350, preferably from about 75 to about 250 dynes/cm$^2$.

DETAILED DESCRIPTION OF THE INVENTION

Polycarboxylate Polymer

A key component of the composition of the present invention is a high molecular weight polycarboxylate polymer thickener. By "high molecular weight" is meant from about 500,000 to about 5,000,000, preferably from about 750,000 to about 4,000,000.

The polycarboxylate polymer may be a carboxyvinyl polymer. Such compounds are disclosed in U.S. Pat. No. 2,798,053, issued on Jul. 2, 1957, to Brown, the specification of which is hereby incorporated by reference. Methods for making carboxyvinyl polymers are also disclosed in Brown.

A carboxyvinyl polymer is an interpolymer of a monomeric mixture comprising a monomeric olefinically unsaturated carboxylic acid, and from about 0.1% to about 10% by weight of the total monomers of a polyether of a polyhydric alcohol, which polyhydric alcohol contains at least four carbon atoms to which are attached at least three hydroxyl groups, the polyether containing more than one alkenyl group per molecule. Other monoolefinic monomeric materials may be present in the monomeric mixture if desired, even in predominant proportion. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, and pentaerythritol; more preferred are oligosaccharides, most preferred is sucrose. It is preferred that the hydroxyl groups of the polyol which are modified be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

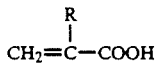

where R is a substituent selected from the group consisting of hydrogen and lower alkyl groups; most preferred is acrylic acid.

Carboxyvinyl polymers useful in formulations of the present invention have a molecular weight of at least about 750,000; preferred are highly cross-linked carboxyvinyl polymers having a molecular weight of at least about 1,250,000; also preferred are carboxyvinyl polymers having a molecular weight of at least about 3,000,000 which may be less highly cross-linked.

Various carboxyvinyl polymers are commercially available from B. F. Goodrich Company, New York, N.Y., under the tradename Carbopol. Carboxyvinyl polymers useful in formulations of the present invention include Carbopol 910 having a molecular weight of about 750,000, preferred Carbopol 941 having a molecular weight of about 1,250,000, and more preferred Carbopols 934 and 940 having molecular weights of about 3,000,000 and 4,000,000, respectively.

Carbopol 934 is a very slightly cross-linked carboxyvinyl polymer having a molecular weight of about 3,000,000. It has been described as a high molecular weight polyacrylic acid cross-linked with about 1% of polyallyl sucrose having an average of about 5.8 allyl groups for each molecule of sucrose.

Additional polycarboxylate polymers useful in the present invention are Sokalan PHC-25 ®, a polyacrylic acid available from BASF Corp., and Gantrez ®, a poly (methyl vinyl ether/maelic acid) interpolymer available from GAF Corp.

Preferred polycarboxylate polymers of the present invention are non-linear, water-dispersible polyacrylic acid cross-linked with a polyalkenyl polyether and having a molecular weight of from about 750,000 to about 4,000,000. Highly preferred examples of these polycarboxylate polymer thickeners for use in the present invention are the Carbopol 600 series resins available from B. F. Goodrich. Especially preferred are Carbopol 616 and 617. It is believed that these resins are more highly cross-linked than the 900 series resins and have molecular weights between 1,000,000 and 4,000,000.

Mixtures of polycarboxylate polymers as herein described may also be used in the present invention. Particularly preferred is a mixture of Carbopol 616 and 617 series resins.

The polycarboxylate polymer thickener is utilized preferably with essentially no clay thickening agents. In fact, it has been found that if the polycarboxylate polymers of the present invention are utilized with clay in the composition of the present invention, a much less desirable product results in terms of phase instability. A trace amount of clay may be acceptable in combination with the polycarboxylate polymer, preferably less than 0.05% clay. In other words, the polycarboxylate polymer is preferably used instead of clay as a thickening/stabilizing agent in the present compositions.

The polycarboxylate polymer also provides a reduction in what is commonly called "bottle hang-up". This term refers to the inability to dispense all of the dishwashing detergent product from its container. Without wishing to be bound by theory, it is believed that the compositions of the present invention provide this benefit because the force of cohesion of the composition is greater than the force of adhesion to the container wall. With clay thickener systems, which most commercially available products contain, bottle hang-up can be a significant problem under certain conditions.

Without wishing to be bound by theory, it is also believed that the long chain molecules of the polycarboxylate polymer thickener help to suspend solids in the detergent compositions of the present invention and help to keep the matrix expanded. The polymeric material is also less sensitive than clay thickeners to destruction due to repeated shearing, such as occurs when the composition is vigorously mixed.

From about 0.1% to about 10%, preferably from about 0.2% to about 2%, of the high molecular weight polycarboxylate polymer is used in the composition of the present invention.

The polymeric thickener is utilized to provide a yield value of from about 50 to about 350, and most preferably from about 75 to about 300.

Yield Value Analysis

The yield value is an indication of the shear stress at which the gel strength is exceeded and flow is initiated. It is measured herein with a Brookfield RVT model viscometer with a T-bar B spindle at 25° C. utilizing a Helipath drive upward during associated readings. The system is set to 0.5 RPM and a reading is taken for the composition to be tested after 30 seconds or after the system is stable. The system is stopped and the RPM is reset to 1.0 RPM. A reading is taken for the same composition after 30 seconds or after the system is stable. Stress at zero shear is equal to two times the 0.5 RPM reading minus the reading at 1.0 RPM. The yield value is calculated as the stress at zero shear times 18.8 (conversion factor).

Phosphate Ester

A second key component of the compositions of the present invention is an ester of phosphoric acid (phosphate ester). Phosphate esters are any materials of the general formula:

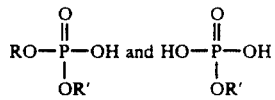

wherein R and R' are $C_6$–$C_{20}$ alkyl or ethoxylated alkyl groups. Preferably R and R' are of the general formula: alkyl—$(OCH_2CH_2)Y$ wherein the alkyl substituent is $C_{12}$–$C_{18}$ and Y is between 0 and about 4. Most preferably the alkyl substituent of that formula is $C_{12}$–$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KW340N and KL340N (Hoescht) and monostearyl acid phosphate (Oxidental Chemical Corp.) Most preferred for use in the present invention is Hostophat-TP-2253 (Hoescht).

The phosphate ester component aids in control of specific gravity of the detergent products of the present invention. The phosphate ester also helps to maintain stability of the product.

The phosphate esters useful herein also provide protection of silver and silver-plated utensil surfaces. The phosphate ester component also acts as a suds suppressor; thus an additional suds suppressor is not required in the anionic surfactant-containing detergent compositions disclosed herein.

These phosphate esters in combination with the polycarboxylate polymer thickener provide enhanced stability to the liquid automatic dishwashing detergent compositions of the present invention. More specifically, the phosphate ester component helps to keep the solid particles in the compositions of the present invention in suspension. Thus, the combination inhibits the separation out of a liquid layer from compositions of this type.

From about 0.1% to about 5%, preferably from about 0.15% to about 1.0% of the phosphate ester component is used in the compositions of the present invention.

Bleach-Stable Detergent Surfactants

The compositions of this invention can contain from 0% to about 10%, preferably from about 0.1% to about 5%, or more preferably from about 0.2% to about 3% of a bleach-stable detergent surfactant based upon the desired end use. The choice of detergent surfactant and amount will depend upon the end use of the product. For example, for an automatic dishwashing product the level of surfactant should be less than about 5%, preferably less than about 3%, and the detergent surfactant should be low sudsing.

Desirable detergent surfactants may include nonionic detergent surfactants, anionic detergent surfactants, amphoteric and zwitterionic detergent surfactants, and mixtures thereof.

Examples of nonionic surfactants include:

(1) The condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9, moles of ethylene oxide. These various specific $C_{17}$–$C_{19}$ ethoxylates give extremely good performance even at lower levels (e.g., 2.5%–3%) and at the higher levels (less than 5%) are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 6,000; 4,500; 3,400; and 1,450. All of these materials are wax-like solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)_x(C_3H_6O)_y(C_2H_4O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO\text{-}(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $-(C_yH_{2y}O)_nH$ wherein y is 3 or 4 and n is a number from one to about 4.

Particularly suitable surfactants are the low-sudsing compounds of (4), the other compounds of (5), and the $C_{17-19}$ materials of (1) which have a narrow ethoxy distribution.

In addition to the above mentioned surfactants, other suitable surfactants can be found in the disclosures of U.S. Pat. Nos. 3,544,473, 3,630,923, 3,888,781 and 4,001,132, all of which are incorporated herein by reference.

Some of the aforementioned surfactants are bleach-stable but some are not. When the composition contains a hypochlorite bleach it is preferable that the detergent surfactant is bleach-stable. Such surfactants desirably do not contain functions, such as unsaturation, and some aromatic, amide, aldehydic, methyl keto or hydroxyl groups which are susceptible to oxidation by the hypochlorite.

Bleach-stable anionic surfactants which are especially resistant to hypochlorite oxidation fall into two main groups. One such class of bleach-stable anionic surfactants are the water-soluble alkyl sulfates and/or sulfonates, containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable anionic surfactant materials operable in the instant invention are the water-soluble betaine surfactants. These materials have the general formula:

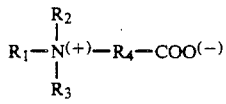

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanotate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Nonionic surfactants useful herein include ethoxylated and/or propoxylated nonionic surfactants such as those available from BASF Corp. of New Jersey. Examples of such compounds are polyethylene oxide, polypropylene oxide block copolymers sold under the trade names Pluronic ® and Tetronic ®, available from BASF Corp.

Preferred members of this class are capped polyalkylene oxide block copolymer surfactants of the following structure:

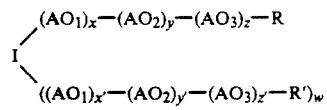

where I is the residue of a monohydroxyl, dihydroxyl, or a polyhydroxyl compound; $AO_1$, $AO_2$, and $AO_3$ are oxyalkyl groups and one of $AO_1$ and $AO_2$ is propylene oxide with the corresponding x or y being greater than zero, and the other of $AO_1$ and $AO_2$ is ethylene oxide with the corresponding x or y being greater than zero, and the molar ratio of propylene oxide to ethylene oxide is from about 2:1 to about 8:1; R and R′ are hydrogen, alkyl, aryl, alkyl aryl, aryl alkyl, carbamate, or butylene oxide; w is equal to zero or one; and z, x′, y′, and z′ are greater than or equal to zero.

Preferably the oxyalkyl groups are oxypropyl, oxyethyl, or oxybutyl, and mixtures thereof; I is the residue of methanol, ethanol, butanol, ethylene glycol, propylene glycol, butylene glycol, bisphenol, glycerine, or trimethylolpropane; and R and R′ are hydrogen, a methyl group, or a butylene oxide group. More preferably in the compounds of this general formula, $AO_1$ is propylene oxide and $AO_2$ is ethylene oxide, and the molar ratio of total propylene oxide to total ethylene oxide is from about 3:1 to about 6:1. Alternatively, compounds of this general formula in which $AO_2$ is propylene oxide and $AO_1$ is ethylene oxide, and the molar ratio of total propylene oxide to total ethylene oxide is from about 3:1 to about 6:1 are also preferred.

Of these compounds, the following structures are preferred:

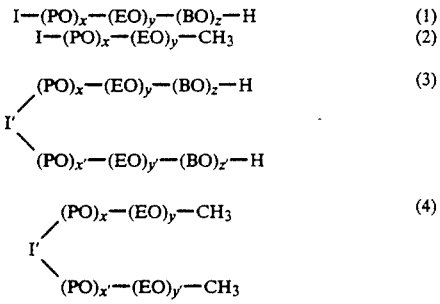

These compounds preferably have molecular weights ranging from about 1000 to about 4000. In these structures I is the residue of a monohydroxyl compound, preferably the residue of methanol, ethanol, or butanol, and I′ is the residue of a dihydroxyl compound, preferably ethylene glycol, propylene glycol, or butylene glycol. Also, EO is an ethylene oxide group; PO is a propylene oxide group; BO is a butylene oxide group; x and x′ are the number of propylene oxide groups; y and y′ are the number of ethylene oxide groups; and z and z′ are the number of butylene oxide groups. Also z and z′ are each greater than zero and preferably are each equal to from about 1 to about 5; x, y, x', and y' are each greater than zero, and the ratio of x to y and x' to y' is from about 3:1 to about 6:1.

The above structures in which the (EO)y and (PO)x sequencing order are reversed are also useful in the present invention. In these reverse structures, y and y' are the number of propylene oxide groups; x and x' are the number of ethylene oxide groups; and the ratio of y to x and y' to x' is from about 3:1 to about 6:1.

Most preferably the nonionic surfactants comprise the following:

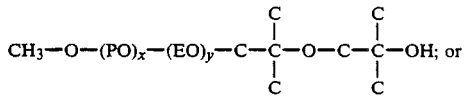

(1)

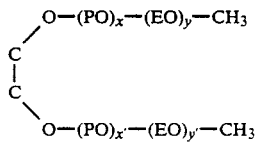

(2)

both molecules having a molecular weight of about 1900, wherein PO is propylene oxide, EO is ethylene oxide, and the molar ratio of PO to EO is from about 4:1 to about 5:1. These surfactants are not only bleach-stable, but they provide low sudsing and superior performance in reducing spotting and filming as well. The preferred of these particular nonionic surfactants is that of formula (1), as this compound is easier to prepare. However, from a bleach stability and performance standpoint, both compounds are equivalent.

Preparation of the compound:

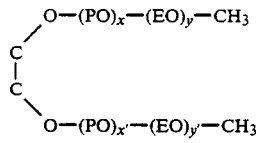

having a molecular weight of about 1900, wherein PO is propylene oxide, EO is ethylene oxide, and the molar ratio of PO to EO is from about 4:1 to about 5:1, is as follows.

The initiator, ethylene glycol, is reacted first with propylene oxide and then with ethylene oxide under base catalysis with KOH to form the potassium salt of the polyol. This is then reacted with either dimethyl sulfate in the presence of sodium hydroxide or with methyl chloride and $CH_3ONa$ or $CH_3OK$ to yield the methyl capped polyalkylene oxide block copolymer nonionic surfactant.

Preparation of the compound:

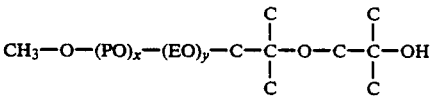

having a molecular weight of about 1900, wherein PO is propylene oxide, EO is ethylene oxide, and the molar ratio of PO to EO is from about 4:1 to about 5:1, is as follows.

The initiator, methanol, is reacted first with propylene oxide and then with ethylene oxide under base catalysis with KOH to yield the potassium salt starting material. A one-gallon Autoclave Engineers, stainless steel autoclave capable of working pressures of up to 150 psig is charged with 2500 g (1.33 moles) of the starting material. The reactor is sealed and evacuated for one hour at 100° C. The temperature is raised to 115° C., and 193 g (2.68 moles) of isobutylene oxide are added over a period of three hours and 45 minutes. Once all of the isobutylene oxide is added, the mixture is allowed to react in the autoclave for three hours. The reaction is complete when the pressure in the autoclave is constant over time with constant temperature. The product is cooled and discharged and subsequently neutralized with phosphoric acid, to yield the isobutylene oxide capped polyaklylene oxide block copolymer nonionic surfactant.

Other bleach-stable surfactants include amine oxides, phosphine oxides, and sulfoxides. However, such surfactants are usually high sudsing. A disclosure of bleach-stable surfactants can be found in published British Patent Application 2,116,199A; U.S. Pat. No. 4,005,027, Hartman; U.S. Pat. No. 4,116,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable bleach-stable surfactants are the alkyl phosphonates, taught in U.S. Pat. No. 4,105,573, to Jacobsen, issued August 8, 1978, incorporated herein by reference.

Still other preferred bleach-stable anionic surfactants include the linear or branched alkali metal mono- and/or di-($C_{8-14}$) alkyl diphenyl oxide mono- and/or disulphonates, commercially available under the tradenames Dowfax 3B-2 (sodium n-decyl diphenyloxide disulfonate) and Dowfax 2A-1. These and similar surfactants are disclosed in published U.K. Patent Applications 2,163,447A; 2,163,448A; and 2,164,350A, said applications being incorporated herein by reference.

Bleaching Agent

The instant compositions also include a bleaching agent which yields a hypochlorite species in aqueous solution. The hypochlorite ion is chemically represented by the formula $OCl^{-1}$. The hypochlorite ion is a strong oxidizing agent, and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine, partially in the form of hypochlorous acid moieties and partially in the form of hypochlorite ions. At pH levels above about 10, i.e., at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form and are dissolved in water during preparation of the compositions of the instant invention. Some of the above materials are available as aqueous solutions.

The above-described bleaching agents are dissolved in the aqueous liquid component of the present composition. Bleaching agents can provide from about 0.1% to 5% available chlorine by weight, preferably from about 0.5% to 2.0% available chlorine by weight, of the total composition.

Buffering Agent

In the instant compositions, it is generally desirable to also include one or more buffering agents capable of maintaining the pH of the compositions within the alkaline range. Preferably the pH range is from about 10.5 to about 12.5. It is in this pH range that optimum performance of the bleach and surfactant are realized, and it is also within this pH range wherein optimum composition chemical stability is achieved.

Maintenance of this particular pH range minimizes the chemical interaction between the strong hypochlorite bleach and the surfactant compounds present in the instant compositions. Finally, as noted, high pH values such as those maintained by an optional buffering agent serve to enhance the soil and stain removal properties during utilization of the present compositions.

Any compatible material or mixture of materials which has the effect of maintaining the composition pH within the alkaline pH range, and preferably within the 10.5 to 12.5 range, can be utilized as the buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, and sodium tetraborate decahydrate. Preferred buffering agents for use herein comprise from about 4% to about 10% sodium silicate, from about 0.5% to about 1.5% sodium hydroxide, and mixtures thereof. Buffering agents for use herein may include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1, and mixtures of anhydrous sodium carbonate and sodium silicate in a carbonate/silicate weight ratio of about 1:3 to about 3:1, preferably from about 1:2 to about 2:1.

If present, the above-described buffering agent materials are dissolved or suspended in the aqueous liquid component. Buffering agents can generally comprise from about 2% to 20% by weight, preferably from about 5% to 15% by weight, of the total composition.

Detergency Builder

Detergency builders are desirable materials which reduce the free calcium and/or magnesium ion concentration in a surfactant-containing aqueous solution. They are used herein at a level of from about 5% to about 40%, preferably from about 15% to about 30%. The preferred detergency builder for use herein is sodium tripolyphosphate in an amount from about 10% to about 40%, preferably from about 20% to about 30%. Generally a certain percentage of the sodium tripolyphosphate is in an undissolved particulate form suspended in the rest of the detergent composition. The phosphate ester component of the present invention works to keep such solid particles suspended in the aqueous solution.

Other detergency builders include potassium pyrophosphate, sodium pyrophosphate, potassium tripolyphosphate, potassium hexametaphosphate, and alkali metal carbonates such as sodium carbonate.

Some of the above-described buffering agent materials additionally serve as builders. It is preferred that the buffering agent contain at least one compound capable of additionally acting as a builder.

Hydroxy Fatty Acid Salt

Because automatic dishwashing detergent compositions contain bleach, sterling or silver-plated flatware can become tarnished after repeated exposures to the harsh composition. Metal salts of long chain hydroxy fatty acids have been found to be useful in automatic dishwashing detergent compositions of this type to inhibit said tarnishing. By "long chain hydroxy fatty acid" is meant the higher aliphatic hydroxy fatty acids having from about 8 to about 22 carbon atoms, preferably from about 10 to 20 carbon atoms, and most preferably from about 12 to 18 carbon atoms, inclusive of the carbon atom of carboxyl group of the fatty acid. Hydroxy stearic acid is especially preferred. By "metal salts" of the long chain hydroxy fatty acids is meant both monovalent and polyvalent metal salts particularly the sodium, potassium, lithium, aluminum and zinc salts. Particularly preferred is the lithium salts of the hydroxy fatty acids. Specific examples of the preferred materials are potassium, sodium and particularly lithium hydroxy stearate. The compounds are compatible with bleach and other components traditionally found in automatic dishwashing detergent compositions. These compounds are essentially insoluble in water. Because of the presence of the hydroxy group in these compounds, they do not significantly affect viscosity of the compositions of the present invention. Thus, the hydroxy fatty acid salts are useful in connection with thickening agents such as clay or polycarboxylate thickeners in automatic dishwashing detergent compositions. The metals salts of long chain hydroxy fatty acids may optionally be incorporated into the automatic dishwashing detergent compositions of the present invention at from about 0.05% to about 0.3%, preferably from about 0.05% to about 0.2%, by weight of the detergent composition.

Other Optional Materials

Conventional coloring agents and perfumes can also be added to the instant compositions to enhance their aesthetic appeal and/or consumer acceptability. These materials should, of course, be those dye and perfume varieties which are especially stable against degradation by high pH and/or strong active chlorine bleaching agents if such bleaching agents are also present.

If present, the above-described other optional materials generally comprise no more than about 10% by weight of the total composition and are dissolved, suspended, or emulsified in the present compositions.

Entrained Gas

Optionally, the compositions of the present invention may comprise entrained gas to further ensure stability.

The entrained gas can be any gaseous material that is insoluble in the aqueous liquid. Air is preferred, but any gas that will not react with the composition, such as nitrogen, is also useful.

The entrained gas bubbles are preferably in very finely divided form, preferably less than about 1/32 in. in diameter. They are dispersed throughout the aqueous liquid in an amount, generally from about 1% to about 20%, preferably from about 5% to about 15% by volume, to lower the specific gravity of the overall composition to within from about 5% more than to about 10% less than, preferably within from about 1% more than to about 5% less than the specific gravity of the aqueous liquid without the entrained gas. It is more desirable to be below the specific gravity of the aqueous phase. Any phase separation is then at the bottom of the container, and pouring will tend to remix the separated phase before it is dispensed.

The gas can be admixed with high shear mixing, e.g., through a shear device that has close tolerances to achieve air bubble size reduction. High shear mixing can be attained with shear rates greater than about 1000 $sec^{-1}$, preferably greater than about 15,000 $sec^{-1}$, most preferably greater than 30,000 $sec^{-1}$. The polycarboxylate polymer, on the other hand, should preferably be added last to minimize excessive exposure to shear. Each of these preferred processing steps gives compositions with superior stability. The gas can also be introduced in finely divided form by using a sparger.

Preferred Composition

Preferred compositions of this invention are liquid automatic dishwasher detergent compositions comprising:

(1) from about 15% to about 25% of sodium tripolyphosphate;
(2) from about 4% to about 10% of sodium silicate;
(3) from about 3% to about 10% of sodium carbonate;
(4) hypochlorite bleach in an amount to provide from about 0.5% to about 1.5% of available chlorine;
(5) from about 0.1% to about 0.5% of sodium n-decyl diphenyloxide disulfonate;
(6) from about 0.2% to about 2% of a polycarboxylic polymer thickening agent selected from the group consisting of polycarboxylic polymers comprising non-linear, water-dispersible polyacrylic acid cross-linked with a polyalkenyl polyether having a molecular weight of from about 750,000 to about 4,000,000, and mixtures thereof;
(7) from about 0.15% to about 1% of an ethoxylated alkyl ester of phosphoric acid having an average alkyl chain length of from about 12 to about 18 carbon atoms and an average number of ethoxylate units of from about 2 to about 4;

said liquid detergent composition containing no clay suspension agents and having a yield value of from about 100 to about 250. Alternately, item number (5) of the composition may comprise from about 0.5% to about 1.5% of a nonionic surfactant of the following structure

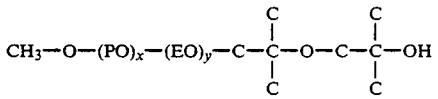

having a molecular weight of about 1900, wherein PO is propylene oxide, EO is ethylene oxide, and the molar ratio of PO to EO is from about 4:1 to about 5:1.

The following examples illustrate the present invention. It will be appreciated that other modifications of the present invention, within the skill of those in the automatic liquid dishwashing detergency art, can be undertaken without departing from the spirit and scope of this invention.

All parts, percentages, and ratios herein are by weight unless otherwise specified.

EXAMPLE I

A liquid automatic dishwashing detergent composition of the present invention is as follows:

| Component | Wt. % |
|---|---|
| Hexahydrate sodium tripolyphosphate | 11.3 |
| Sodium tripolyphosphate (anhydrous basis) | 10.0 |
| Sodium silicate solids (2.4 R) | 7.0 |
| Sodium carbonate | 6.0 |
| Available chlorine from sodium hypochlorite | 1.0 |
| Polyacrylate thickener-Carbopol 616 | 0.2 |
| Polyacrylate thickener-Carbopol 617 | 0.25 |
| Ethoxylated phosphate ester-Hostophat TP-2253 | 0.2 |
| Sodium hydroxide | 0.95 |
| Anionic surfactant (Dowfax 3B2) | 0.4 |
| Lithium hydroxystearate | 0.1 |
| Minor ingredients and water | Balance |

The composition is prepared as follows. The NaOCl, NaOH, sodium silicate, perfume, and water are combined in a stainless steel container which is placed in an ice bath. A Ross mixer is used to high shear mix the contents of the container while adding the hexahydrate sodium tripolyphosphate, the sodium tripolyphosphate (anhydrous), and the sodium carbonate. Mixing is continued until the particle size is acceptably small, i.e., no visible chunks of sodium tripolyphosphate or sodium carbonate particles can be seen in a thin film of the mixture on a stainless steel spatula. Mixing is continued as the phosphate ester and anionic surfactant and lithium hydroxystearate are added and until the specific gravity of the mixture is about 1.27. Mixing is then stopped and the container is removed from the ice bath. A paddle mixer is then placed into the mixture. The dye is then paddled into the mixture. In a separate container the polycarboxylate polymer is premixed with enough water to moisten the polymer. The polymer slurry (2.5%) is then paddled into the mixture of the other components.

This liquid dishwashing detergent has a pH of about 12.2, a yield value of about 150, and a specific gravity of about 1.25. This detergent composition has enhanced phase stability when compared with similar products thickened with clay or other colloid thickeners. This enhanced phase stability can be seen when the composition is stored at 25° C. for four months; no separation out of a liquid phase results. This is comparable to at least 1% separation out of a liquid phase for traditional clay-thickened automatic dishwashing detergent compositions in a much shorter period of time. This detergent also provides reduced bottle hang-up.

Other compositions of the present invention are obtained when the Carbopol® polyacrylate thickeners are replaced in whole or in part with polyacrylate polymers sold under the trade names Sokalan PHC-25®, available from BASF Corp., or Gantrez®, available from GAF Corp.

Yet other compositions of the present invention are obtained when the Hostophat TP-2253 ethoxylated phosphate ester is replaced in whole or in part with phosphate esters sold under the trade names KW340N® or KL340N®, available from Hoescht, or monostearyl acid phosphate, available from Oxidental Chemical Corp.

EXAMPLE II

A liquid automatic dishwashing detergent composition of the invention is as follows:

| Component | Wt. % |
|---|---|
| Sodium tripolyphosphate (anhydrous basis) | 20.0 |
| Capped polyalkaline oxide block copolymer nonionic surfactant of the following formula: | 1.0 |

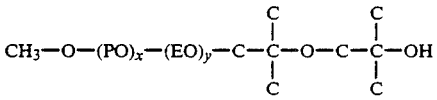

| | |
|---|---|
| Sodium carbonate | 6.0 |
| Sodium hydroxide | 0.95 |
| Available chlorine from sodium hypochlorite | 1.0 |
| Sodium silicate solids (2.4R) | 6.54 |
| Polyacrylate thickener-Carbopol 616 | 0.20 |
| Polyacrylate thickener-Carbopol 617 | 0.25 |
| Ethoxylated phosphate ester-Hostophat TP-2253 | 0.20 |

The composition is prepared as follows. The NaOCl, NaOH, sodium silicate, perfume, phosphate ester, and water are combined in a stainless steel container which is placed in an ice bath. A Ross mixer is used to high shear mix the contents of the container while adding the hexahydrate sodium tripolyphosphate and the sodium carbonate. Mixing is continued until the particle size is acceptably small, i.e., no visible chunks of sodium tripolyphosphate or sodium carbonate particles can be seen in a thin film of the mixture on a stainless steel spatula. Mixing is continued as the nonionic surfactant is added. Mixing is then stopped and the container is removed from the ice bath. A paddle mixer is then placed into the mixture. The dye is then paddled into the mixture. In a separate container the polycarboxylate polymer is premixed with enough water to moisten the polymer. The polymer slurry (2.5%) is then paddled into the mixture of the other components.

The resulting automatic dishwashing detergent composition has a pH (1% solution) of about 11, a yield value of about 150, and a specific gravity of about 1.32. This detergent composition has enhanced phase stability when compared with similar products thickened with clay or other colloid thickeners. This enhanced phase stability can be seen when the composition is stored at 25° C. for four months; no separation out of a liquid phase results. This is comparable to at least 1% separation out of a liquid phase for traditional clay-thickened automatic dishwashing detergent compositions in a much shorter period of time. This detergent also provides reduced bottle hang-up.

Another composition of the present invention is obtained when the nonionic surfactant of Example II is replaced with a compound of the following formula:

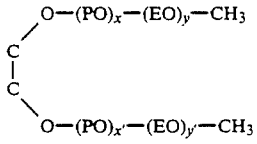

having a molecular weight of about 1900, wherein PO is propylene oxide, EO is ethylene oxide, and the molar ratio of PO to EO is from about 4:1 to about 5:1.

What is claimed is:

1. A liquid automatic dishwashing detergent composition comprising:

(a) from 0% to about 5% of bleach-stable surfactant;

(b) from about 5% to about 40% of detergency builder;

(c) hypochlorite bleach to yield available chlorine in an amount of from about 0.3% to about 2.5%;

(d) from about 0.1% to about 10% of polycarboxylate polymer thickening agent, selected from the group consisting of polycarboxylate polymers comprising non-linear water-dispersible polycarylic acid cross linked with a polyalkenyl polyether, and having a molecular weight of from about 750,000 to about 4,000,000; and mixtures thereof; and (e) from about 0.1% to about 5% of a $C_{12}$–$C_{18}$ alkyl ester of phosphoric acid;

said liquid detergent composition containing essentially no clay suspension agents and having a yield value of from about 50 to about 350 dynes/cm$^2$.

2. The composition of claim 1 comprising:

(a) from about 0.1% to about 2.5% of bleach-stable surfactant;

(b) from about 15% to about 30% of detergency builder;

(c) from about 0.5% to about 1.5% available chlorine from an alkali metal hypochlorite bleach;

(d) from about 0.2% to about 2% of the polycarboxylate polymer thickening agent; and (e) from about 0.15% to about 1% of a $C_{12}$–$C_{18}$ alkyl ester of phosphoric acid;

said composition containing essentially no clay suspension agents and having a yield value of from about 75 to about 250 dynes/cm$^2$.

3. The composition of claim 2 wherein said detergency builder is selected from the group consisting of sodium tripolyphosphate, sodium carbonate, potassium pyrophosphate, sodium pyrophosphate, and mixtures thereof.

4. The composition of claim 1 which additionally comprises from about 4% to about 10% of sodium silicate.

5. The composition of claim 1 which additionally comprises from about 0.5% to about 1.5% sodium hydroxide.

6. The composition of claim 5 wherein said alkyl ester of phosphoric acid is an ethoxylated alkyl ester of phosphoric acid.

7. The composition of claim 6 wherein said alkyl ester of phosphoric acid has from 0 to about 4 ethoxylate units.

8. The composition of claim 7 wherein said ethoxylated alkyl ester of phosphoric acid has an average alkyl chain length of from about 12 to about 18 carbon atoms and an average number of ethoxylate units of from about 2 to about 4.

9. The composition of claim 1 which comprises from about 0.1% to about 5% of said bleach-stable surfactant and wherein said surfactant is an anionic surfactant and is selected from the group consisting of $C_{8-18}$ alkyl sulfates, $C_{8-18}$ alkyl sulfonates, and mixtures thereof.

10. The composition of claim 7 wherein said anionic surfactant is sodium n-decyl diphenyloxide disulfonate.

11. The composition of claim 1 which comprises from about 0.1% to about 5% of said bleach-stable surfactant and wherein said surfactant is a nonionic surfactant and is selected from the group consisting of

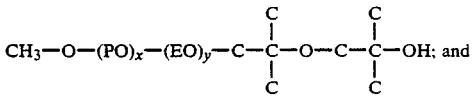

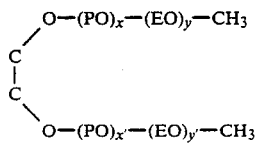

having molecular weights of about 1900, where PO is propylene oxide, EO is ethylene oxide, and the molar ratio of PO to EO is from about 4:1 to about 5:1, and mixtures thereof.

12. The composition of claim 11 wherein said nonionic surfactant is

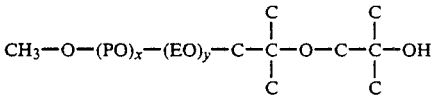

having a molecular weight of about 1900, wherein PO is propylene oxide, EO is ethylene oxide, and the molar ratio of PO to EO is from about 4:1 to about 5:1.

13. A liquid automatic dishwashing detergent composition comprising:

(a) from about 15% to about 25% of sodium tripolyphosphate;

(b) from about 4% to about 10% of sodium silicate;

(c) from about 3% to about 10% of sodium carbonate;

(d) hypochlorite bleach in an amount to provide from about 0.5% to about 1.5% of available chlorine;

(e) from about 0.1% to about 0.5% of sodium n-decyl diphenyloxide disulfonate;

(f) from about 0.2% to about 2% of a polycarboxylate polymer thickening agent selected from the group consisting of polycarboxylate polymers comprising non-linear water-dispersible polyacrylic acid cross-linked with a polyalkenyl polyether having a molecular weight of from about 750,000 to about 4,000,000, and mixtures thereof;

(g) from about 0.15% to about 1% of an ethoxylated alkyl ester of phosphoric acid having an average alkyl chain length of from about 12 to about 18 and an average number of ethoxylate units of from about 2 to about 4;

said liquid detergent composition containing no clay suspension agents and having a yield value of from about 100 to about 250.

14. A liquid automatic dishwashing detergent composition comprising:

(a) from about 15% to about 25% of sodium tripolyphosphate;

(b) from about 4% to about 10% of sodium silicate;

(c) from about 3% to about 10% of sodium carbonate;

(d) hypochlorite bleach in an amount to provide from about 0.5% to about 1.5% of available chlorine;

(e) from about 0.5% to about 1.5% of a bleach-stable nonionic surfactant having the formula

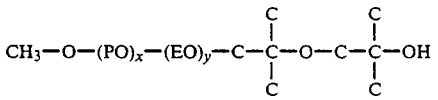

and having a molecular weight of about 1900, wherein PO is propylene oxide, EO is ethylene oxide, and the molar ratio of PO to EO is from about 4:1 to about 5:1;

(f) from about 0.2% to about 2% of a polycarboxylate polymer thickening agent selected from the group consisting of polycarboxylate polymers comprising non-linear, water-dispersible polyacrylic acid cross-linked with a polyalkenyl polyether having a molecular weight of from about 750,000 to about 4,000,000, and mixtures thereof;

(g) from about 0.15% to about 1% of an ethoxylated alkyl ester of phosphoric acid having an average alkyl chain length of from about 12 to about 18 and an average number of ethoxylate units of from about 2 to about 4;

said liquid detergent composition containing no clay suspension agents and having a yield value of from about 100 to about 250.

* * * * *

UNITED STATES PATENT AND TRADEMARK OFFICE

CERTIFICATE OF CORRECTION

PATENT NO. : 5,130,043

DATED : July 14, 1992

INVENTOR(S) : Mark J. Prince and Thomas H. Glassco

It is certified that error appears in the above-identified patent and that said Letters Patent is hereby corrected as shown below:

Col. 15, line 24, "polyalkaline" should read --polyalkylene--.

Col. 16, line 26, "polycarylic" should read --polyacrylic--.

Col. 17, line 8, "claim 7" should read --claim 9 --.

Signed and Sealed this

Twenty-eighth Day of September, 1993

Bruce Lehman

*Attest:*

BRUCE LEHMAN

*Attesting Officer*

*Commissioner of Patents and Trademarks*